United States Patent [19]

Shibata et al.

[11] 4,444,036

[45] Apr. 24, 1984

[54] METHOD OF FORMING A COIL SPRING

[75] Inventors: Masaharu Shibata, Kamakura; Tsutomu Furuyama, Yokohama, both of Japan

[73] Assignee: NHK Spring Co., Ltd., Yokohama, Japan

[21] Appl. No.: 281,946

[22] Filed: Jul. 10, 1981

[30] Foreign Application Priority Data

Jul. 18, 1980 [JP] Japan ..... 55-98473

[51] Int. Cl.[3] ..... B21F 3/10

[52] U.S. Cl. ..... 72/138

[58] Field of Search ..... 72/135, 138, 145, 170, 72/171, 172, 173, 174, 175, 371, 142, 143

[56] References Cited

U.S. PATENT DOCUMENTS

| | | | |
|---|---|---|---|
| 204,030 | 5/1878 | Green | 72/138 |
| 432,741 | 7/1890 | Spuhl | 72/138 X |
| 1,930,329 | 10/1933 | Vinar | 72/138 X |
| 1,985,392 | 12/1934 | Wunderlich | 140/1 |
| 2,179,389 | 11/1939 | Turner et al. | 72/138 |
| 2,339,424 | 1/1944 | Poole | 72/145 |
| 3,420,080 | 1/1969 | Supina et al. | 72/138 |
| 3,996,779 | 12/1976 | Hawley | 72/142 |
| 4,112,721 | 9/1978 | Takase et al. | 72/138 X |
| 4,114,432 | 9/1978 | Miura et al. | 72/135 |

FOREIGN PATENT DOCUMENTS

| | | | |
|---|---|---|---|
| 1334528 | of 1928 | Australia . | |
| 205698 | 1/1957 | Australia . | |
| 636198 | 2/1962 | Canada | 72/135 |
| 552004 | 6/1932 | Fed. Rep. of Germany . | |
| 2435482 | 2/1975 | Fed. Rep. of Germany . | |
| 2628937 | 12/1977 | Fed. Rep. of Germany . | |
| 1258118 | 5/1960 | France . | |
| 1237120 | 6/1960 | France | 72/135 |
| 356428 | 10/1931 | United Kingdom | 72/143 |
| 978819 | 12/1964 | United Kingdom . | |

OTHER PUBLICATIONS

"Los Muelles" -Teoria Y Practica de la Fabricacion, Armand G. Ligier, Edited in 1967, pp. 148-149.

Extract from "Tool Engineers Handbook" Published by McGraw Hill Book Company (open to Public Inspection 2/21/69).

"Metals Handbook", vol. 4, Forming (open to Public Inspection 5/26/77)-p. 313.

*Primary Examiner*—E. Michael Combs

*Attorney, Agent, or Firm*—Frishauf, Holtz, Goodman and Woodward

[57] ABSTRACT

A method of forming a coil spring wherein, an element wire transferred longitudinally is passed between a support roller and a first pressing roller and then between the support roller and a second pressing roller. Coil springs with desired diameters are formed by varying the relative positions of the support roller and the first and second pressing rollers to curve the element wire with desired curvatures. The coil is supported to prevent it from sagging due to gravity acting thereon.

9 Claims, 13 Drawing Figures

METHOD OF FORMING A COIL SPRING

BACKGROUND OF THE INVENTION

This invention relates to a method of forming a coil spring including feeding an element wire along its longitudinal direction for forming a coil spring.

Generally known are several methods of forming a coil spring with a desired pitch and diameter by running an element wire in the aforesaid manner. As an example, there is a method in which the element wire is spirally wound around a core member. This method, however, is subject to the following drawbacks. First, in hot-forming e.g. a barrel-shaped spring, the formed spring cannot be separated from the core bar unless the core member is axially displaced for approximately half a pitch and rotated, so that the manufacture and handling of the core member requires special care. Secondly, the formation of end turn portions with a pitch different from that of the principal part of the coil spring requires a separate process. In order to remove such awkwardness, there is proposed the use of a bevel core member whose external shape can be changed by means of a suitable link mechanism. With use of such core member, however, produced coil springs are liable to become polygonal. Further known is a method of manufacturing a coil spring without using any core member. In this method, an element wire running along its longitudinal direction to be curved is pressed against coiling points arranged substantially at right angles to the running direction. Although having many advantages, this method is also subject to some drawbacks as follows. First, this method requires a strongly-built coiling machine because of great force being applied to the coiling points when using an element wire with a large diameter (e.g. 10 mm or more). Secondly, manufacture of only one coil spring requires an element wire with a length corresponding to at least several springs to be fed into the coiling machine, so that the formed coil spring, as well as the coiling machine, cannot help being costly. Thirdly, with scratches or gashes no formed coil springs produced by a hot working process are adaptable for practical use.

SUMMARY OF THE INVENTION

The object of this invention is to provide a method of forming a coil spring efficiently with a desired coil diameter independently of the thickness of a spring element wire used by means of a relatively cheap coiling machine free from the aforementioned drawbacks of the prior art coiling machine.

To this end, a method of forming a coil spring according to this invention comprises feeding an element wire through a first gap defined between a support roller disposed on one side of a feed path of the element wire and having a rotating shaft substantially perpendicular to the path of the element wire and a first pressing roller disposed on the other side of the path and having a rotating shaft substantially parallel with the support roller, and feeding the element wire passed through the first gap through a second gap defined between the support roller and a second pressing roller disposed on the same side of the element wire as the first pressing roller and having a rotating shaft substantially parallel with the first pressing roller, wherein the winding radius of each portion of the coil spring is determined by pressing the element wire against the surface of the support roller by means of the first and second pressing rollers and curving the element wire with a radius depending on the relative positions of the three rollers. The wire is supported to prevent it from sagging due to gravity acting thereon.

Various effects may be obtained with use of the above-mentioned method of coil spring manufacture. First, the coil element wire can be curved with various curvatures by changing the relative positions of the three rollers, so that coil springs with various shapes can be easily formed without using core members of various kinds that are required for the conventional method of coil spring forming by means of core members. Secondly, a coil spring with various diameter portions, such as a conical spring or barrel-shaped spring, can be easily manufactured by controlling the positions of the rollers during the forming operation. Moreover, since the positions of the rollers can be controlled by the use of e.g. a computer, coil springs with substantially correct dimensions can be manufactured by the use of an attachment device for automatically measuring the principal dimensions of finished coil springs, as well as a well-known automatic controller which is used for shifting the roller positions if the measurement results are different from reference values. Further used may be a self-learning circuit which changes the reference values according to the measurement results. The formation of the conical spring or barrel-shaped spring can be automatically performed while storing a computer or suitable memory with roller positions for a coil diameter corresponding to the feed length of the element wire and comparing the stored data with actual measurement data on the element wire length. According to this invention, unlike in the method using the coiling points, the coiling machine is subjected to no great force, and can therefore be of slender build. Further, it is unnecessary continually to feed the coiling machine with a spring element wire having a length corresponding to a plurality of coil springs, so that the material cost required, for example, for trial manufacture of coil springs may be minimized. Moreover, if the rollers are so designed as to rotate at a peripheral speed substantially equal to the running speed of the element wire, the element wire will never be in slide contact with the rollers. Accordingly, it will be possible to prevent the production of scratches on the element wire which may be caused when the element wire runs against the coiling points to be curved. This will not only improve the strength and external appearance of the products or coil springs, but also reduce the variations in their properties.

DETAILED DESCRIPTION OF THE PREFERRED EMBODIMENT

Figure 1:
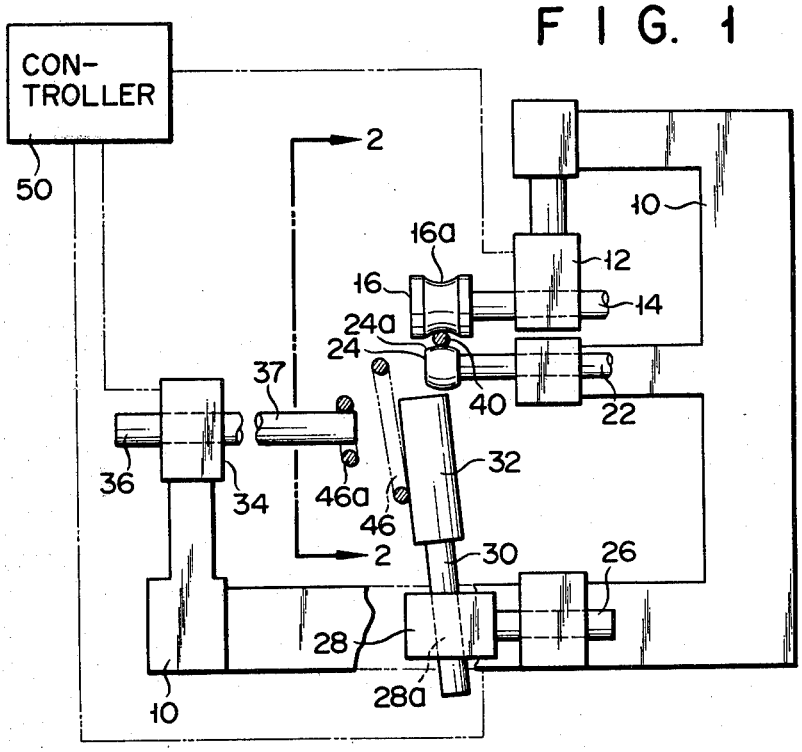
FIG. 1 shows the principal part of a coiling machine for executing the method of this invention.
Figure 2:
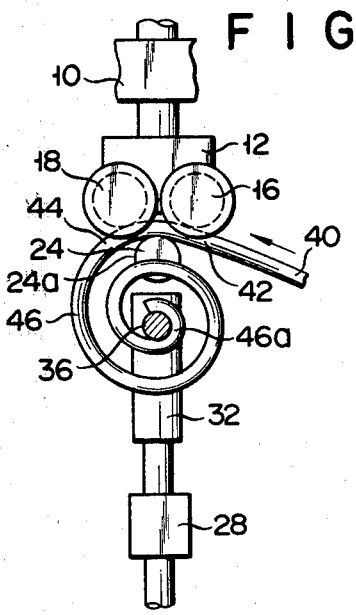
FIG. 2 is a sectional view of the coiling machine as taken along line 2—2 of FIG. 1.

This invention will now be described with reference to the accompanying drawings. FIG. 1 shows an example of the principal part of a coiling machine for executing the method of the invention, and FIG. 2 is a sectional view taken along line 2—2 of FIG. 1. A frame 10 is fitted with a first support member 12 capable of vertical movement. Two shafts 14 which protrude substantially horizontally are rotatably supported to the first support member 12, and first and second pressing rollers 16 and 18 are attached to the respective tip ends of the shafts 14 (see FIG. 2). The frame 10 is rotatably fitted with a shaft 22 extending below the shafts 14 substantially in parallel with the shafts 14, and a support roller 24 is attached to the tip end of the shaft 22. The frame 10 is further fitted with a shaft 26 which extends substantially under the shaft 22 and substantially in parallel therewith, and can slide axially. A second support member 28 is fixed to the tip end of the shaft 26, a shaft 30 extends through a hole 28*a* bored through the member 28, and a pitch tool 32 is fitted on the upper end portion of the shaft 30. Furthermore, the frame 10 is fitted with a third support member 34 capable of vertical movement. Fitted in the member 34 is a movable shaft 36 which extends substantially horizontally toward the pitch tool 32 and can slide axially. An end support shaft 37 is attached to the tip end of the shaft 36.

As shown in FIGS. 1 and 2, a spring element wire or material 40 is transferred longitudinally by means of a suitable feed roller (not shown) or by driving all or some of the support roller 24 and the pressing rollers 16 and 18, and passes through gaps 42 and 44 defined between the support roller 24 and the pressing rollers 16 and 18. At this time, the spring element wire 40 is continuously curved to obtain a desired curvature by moving the first support member 12 to control the relative positions of the pressing rollers 16 and 18 and the support roller 24.

Figure 4:
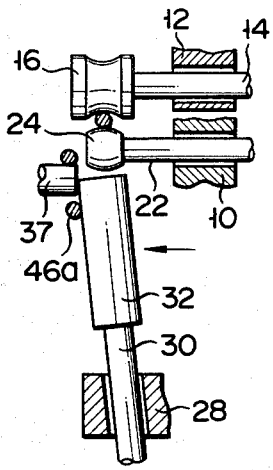
FIG. 4 shows the relative positions of the rollers and the pitch tool where a portion of the coil spring apart from the end turn portion is being coiled.

In forming a barrel-shaped spring 46 (FIG. 5) after the second support member 28 is moved to the left of FIG. 4 to give the spring 46 a predetermined pitch, the first support member 12 and hence the pressing rollers 16 and 18 are gradually raised to increase the radius of curvature of the element wire 40 defined by the relative positions of the rollers 16, 18 and 24, and thus the first half of the barrel-shaped portion of the spring 46 to be formed is coiled. Thereafter, the second half of the barrel-shaped portion and the rear end turn portion 46*b* of the spring 46 can be formed by shifting the vertical position of the first support member 12 and the position of the pitch tool 32 oppositely to the aforesaid manner. During this forming operation, other rollers than the rollers which drive the element wire 40 to travel, are rotating in contact with the wire 40.

Figure 3:
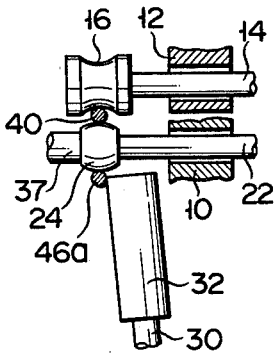
FIG. 3 shows the relative positions of rollers and a pitch tool where the front end turn portion of a coil spring is being formed.
Figure 5:
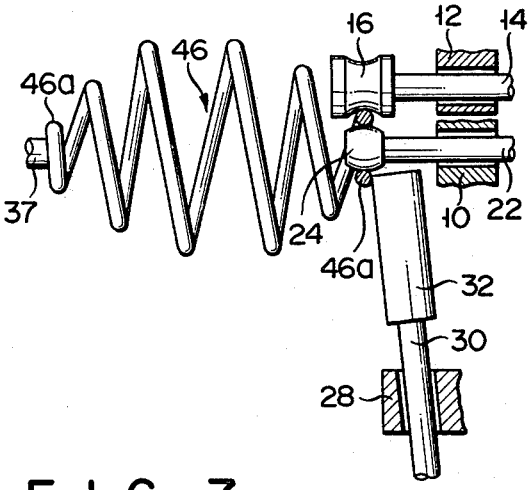
FIG. 5 shows the relative positions of the rollers and the pitch tool where the rear end turn portion of the coil spring is being formed.

In the aforementioned formation of the coil spring, as may be seen from FIGS. 3 to 5, the front end turn portion 46*a*, along with the following coiled portion of the element wire 40, tends to move first to the lower left for the coiling of the first half of the barrel-shaped portion, and then to the upper left for the coiling of the second half. If the front end turn portion 46*a* is left free, then the coiled portion will possibly vibrate and sag by its own gravity. Such vibration and sag can be prevented by moving the third support member 34 vertically and the movable shaft 36 in the transverse direction of FIG. 1, thereby inserting the end support shaft 37 in the front end turn portion 46*a* to support the same, and thereafter moving the third support member 34 and the movable shaft 36 by computer control based on a predetermined program to maintain the support of the front end turn portion 46*a*.

When the coiling of the rear end turn portion 46*b* is finished in the aforementioned manner, the element wire 40 is cut by means of a suitable cutter 92 (see FIG. 10), and the formed coil spring is removed from the support roller 24 and the movable shaft 36 to be taken out of the coiling machine. After the coil spring is taken out in this way, the movable shaft 36 is returned to its initial position, and the coiling machine starts to form another barrel-shaped spring.

Figure 6A:
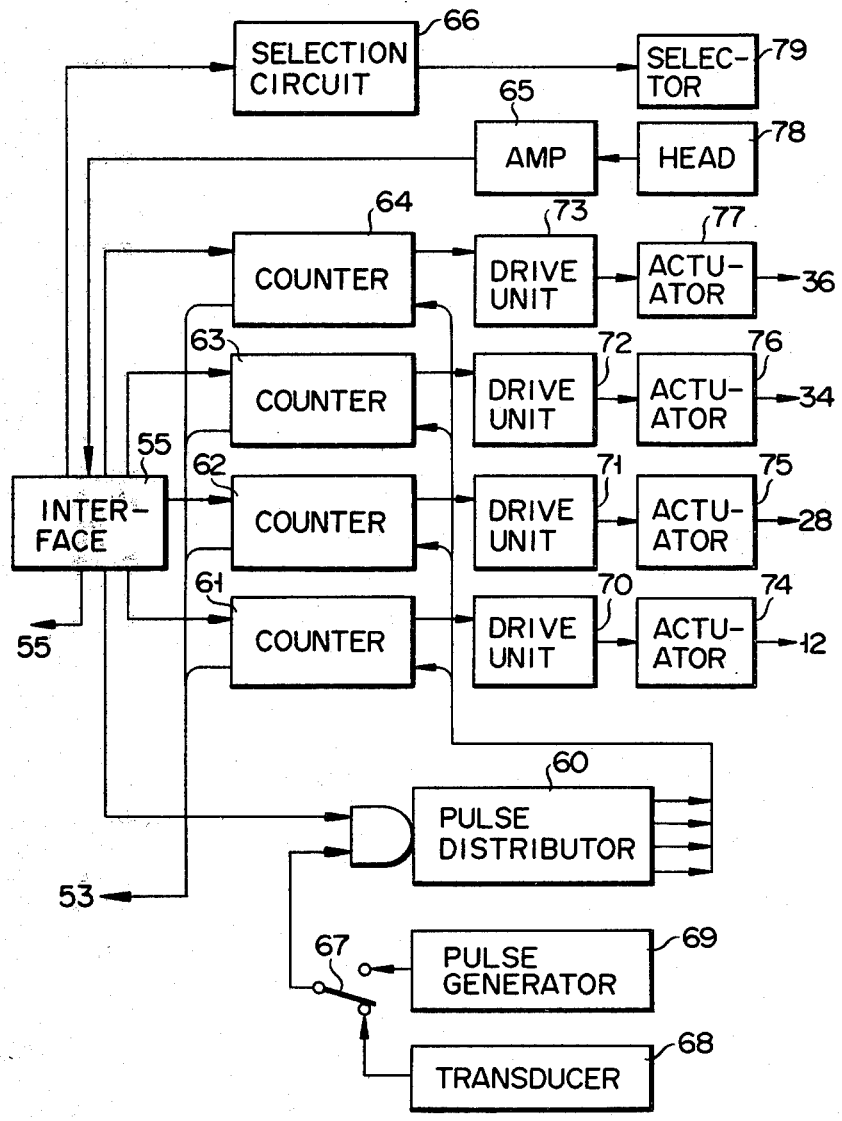
FIGS. 6A and 6B are block diagrams of a controller for operating the coiling machine of FIG. 1.
Figure 6B:
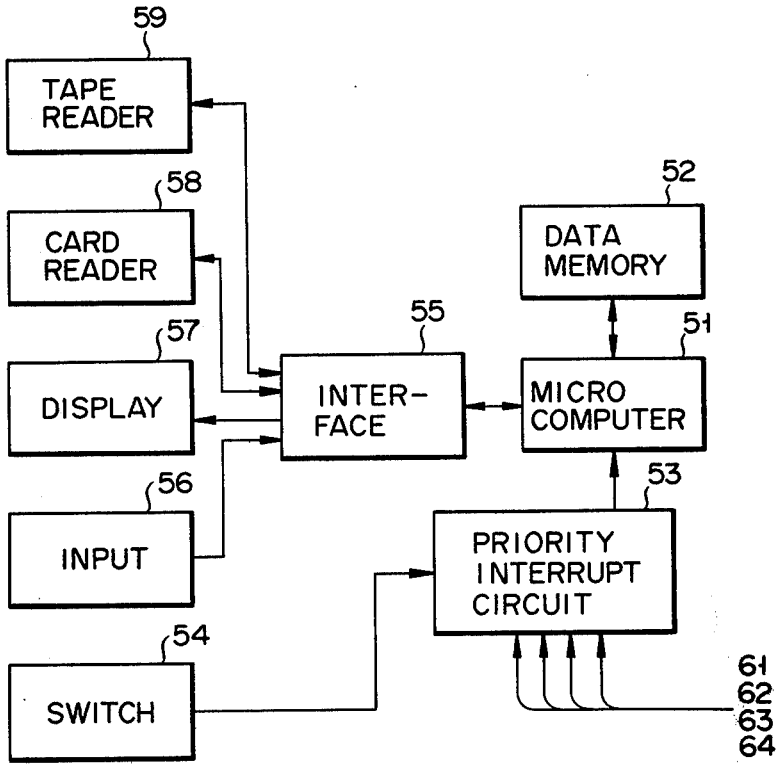

The above-mentioned coil spring forming operation can be performed by using a mechanical apparatus having a cam mechanism, link mechanism, etc. The method according to this embodiment, however, uses a controller 50 including a microcomputer 51, as shown in FIG. 6A and FIG. 6B. In FIG. 1, mechanical connections between the controller 50 and the first, second and third support members 12, 28 and 34 driven by the controller 50 are represented by imaginary lines. The controller 50 is provided with a data memory 52, a priority interrupt circuit 53, and a start switch 54, as well as the microcomputer 51. The microcomputer 51 is connected through an interface 55 with an input unit 56, display unit 57, magnetic card reader 58, magnetic tape reader 59, pulse distributor 60, counters 61 to 64, amplifier 65, and selection circuit 66 for the free length of the coil spring. Further, the priority interrupt circuit 53 and the pulse distributor 60 are severally connected with the counters 61 to 64. The pulse distributor 60 is connected through a changeover switch 67 with a pulse signal generator 69 which produces a pulse signal corresponding to the feed length of the element wire 40. The counters 61 to 64 operate drive units 70 to 73, which drive actuators 74 to 77, respectively. The actuators 74, 75, 76 and 77 actuate the first, second and third support members 12, 28 and 34 and the movable shaft 36, respectively. The amplifier 65 is connected with a head 78 for detecting the free length of the coil spring 46, and the free length selection circuit 66 is connected with a selector 79 for classifying the coil spring 46.

Now there will be given an outline of the operation of the controller 50. First, data on the coil spring 46, such as the reference values and allowable deviations of the length of the element wire 40 necessary for forming the coil spring, the diameter, pitch and free length of the completed coil spring 46, etc., are stored in the memory section of the microcomputer 51 or in the data memory 52. Then, the start switch 54 is operated to interrupt the microcomputer 51, and the counters 61 to 64 are supplied severally with numbers of pulses corresponding to the stored data. When the changeover switch 67 is shifted to the side of a transducer 68, the pulse distributor 60 is supplied with a number of pulses corresponding to the length of the element wire 40 actually fed to a curving mechanism consisting of the support roller 24 and the pressing rollers 16 and 18. The pulse generator 69, which may be replaced with the transducer 68 by the operation of the changeover switch 67, is used for supplying suitable pulses to the pulse distributor 60 to check out or adjust the coiling machine or as an emergency measure in case of trouble of the transducer 68.

In response to a command signal from the microcomputer 51, the pulse distributor 60 supplies the counters 61 to 64 with a pulse signal corresponding to the actually measured length of the spring element wire supplied thereto. If the pulse signal from the transducer 68 coincides with a previously supplied command signal related to the spring element wire, then the counters 61 to 64 supply the drive units 70 to 73 with a pulse signal for driving the actuators 74 to 77 as required. Thus, the first, second and third support members 12, 28 and 34 move vertically and the movable shaft 36 moves axially, so that the pressing rollers 16 and 18, pitch tool 32, and end support shaft 37 move as required. When the operation of the actuators 74 to 77 is completed, an operation end signal is delivered from the counters 61 to 64 to interrupt the microcomputer 51 through the priority interrupt circuit 53, and subsequent command signals are supplied from the microcomputer 51 and the data memory 52 to the counters 61 to 64. When the signal delivered from the transducer 68 reaches a next predetermined value, the actuators 74 to 77 are operated in accordance with the command data. Such operation is performed continuously until the coil spring 46 is formed at the forward end of the element wire 40. The coil spring 46 is cut off by the cutter 92 (see FIG. 10), the free length of the spring 46 is detected by the free length detecting head 78, and the detection value is transmitted through the amplifier 65 and the interface 55 to the microcomputer 51, where it is compared with the previously stored reference value. If the result of such comparison takes a value exceeding the predetermined value of deviation, the free length selection circuit 66 operates in accordance with the command signal delivered from the microcomputer 51, and the coil spring 46 is classified according to the free length by the selector 79 which is controlled by the circuit 66. These operations can be automatically executed in accordance with programs previously stored in the microcomputer 51 and other memories. Further, if the comparison result or deviation is found to be outside the allowable range, the reference value of the data stored in the computer 51 and/or data memory 32 can be automatically corrected to keep the deviation within the predetermined range.

According to the above-mentioned method, many advantages can be obtained. First, by varying the relative positions of the rollers (24, 16, 18) coil springs having a various coil diameters and coil springs each having portions with various diameter are easily produced. Second, formed coil springs can readily be removed from the coiling machine. Thirdly it is not necessary to provide various core members of different shapes and so the cost for providing core members and manufacturing cost for making the coil spring are reduced. Further, the support roller 24, pressing rollers 16 and 18, the pitch tool 32 and all rollers in contact with the element wire 40 run at a peripheral speed substantially equal to the running speed of the element wire 40, so that it is possible to minimize the incidence of flawing on the element wire due to slip which is a problem in the case of hot forming. Moreover, if the force to roll in the front end of the element wire between the support roller 24 and the pressing rollers 16 and 18 need be strong, or if it is improper to leave a straight rear end portion of the element wire at the end of the coil spring forming operation, then it is necessary only that the outside diameter of the support roller 24 be substantially equal to the inside diameter of the end turn portion 46*a*. With use of the controller 50 operating in the aforementioned manner, a wide variety of coil springs can be formed by variously shifting the positions of the support roller 24, the pair of pressing rollers 16 and 18, and the pitch tool 32 in accordance with instructions from the microcomputer. Thus, the arrangements for the coil spring forming are simple, and the attachment tools for the coiling machine can be reduced in number. It is not very difficult automatically to control a heat treatment process for the coil spring by means of the microcomputer.

Figure 10:
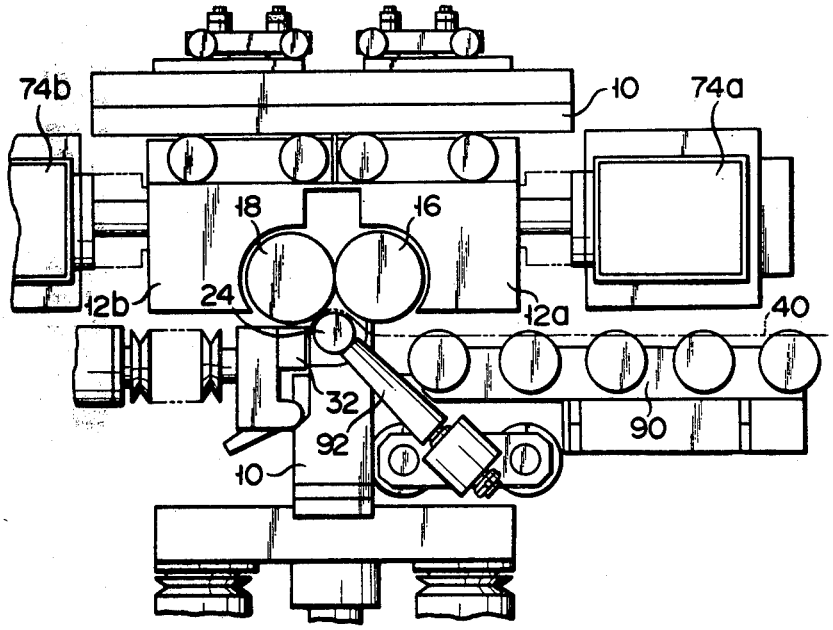
FIGS. 10 and 11 are front and plan views of a mechanism for driving the support and pressing rollers, respectively.
Figure 11:
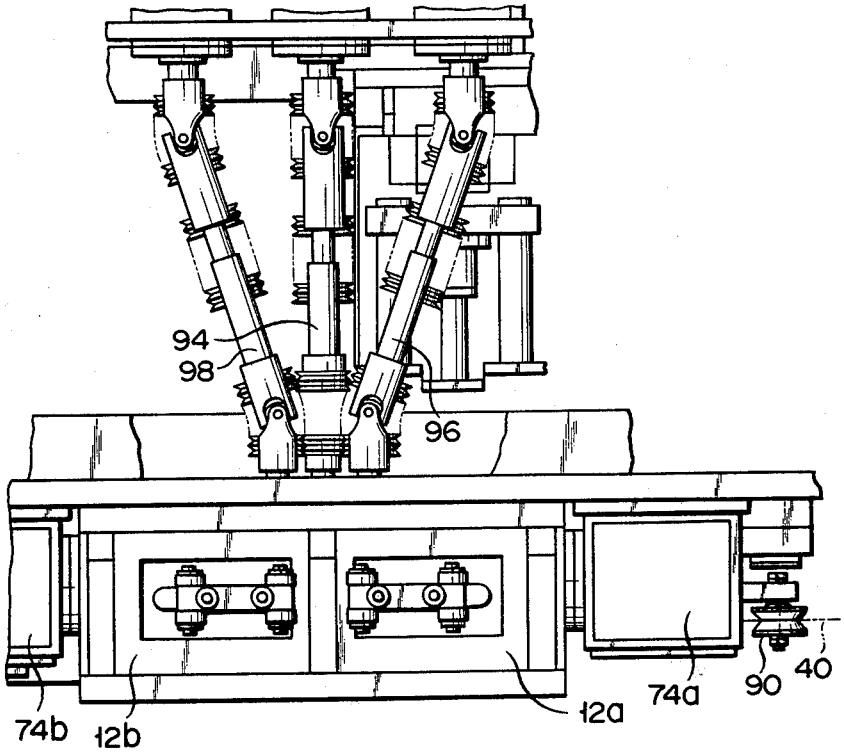

FIGS. 10 and 11 are front and plan views showing the principal part of another coiling machine for executing the method of the invention, respectively. In this coiling machine, pressing rollers 16 and 18 are rotatably attached to support members 12*a* and 12*b*, respectively, and can advance and retreat substantially in parallel (transverse direction in the figures) with a path along which an element wire 40 is fed to the rollers 16, 18 and 14. In FIGS. 10 and 11, there are shown a pair of actuators 74*a* and 74*b* which drive the support members 12*a* and 12*b*, respectively, and a feed roller 90 for the element wire 40, cutter 92, driving shaft 94 for rotating the support roller 24, and driving shafts 96 and 98 for the pressing rollers 16 and 18. Each of these driving shafts 94, 96, 98 is designed to be adapted for extension and contraction and each end of the driving shaft is provided with a universal joint. If necessary, one or more driving shafts 92, 94, 96 to be rotated are coupled to power sources for driving the support roller 24 and the pressing rollers 16 and 18.

By the displacement of the one or both of the pressing rollers 16, 18 against the support roller 24, relative positions of the rollers are varied and the radius of curvature of each coil portion is changed. In FIG. 11 support roller 24 can be displaced vertically of the drawing and various winding radii can be obtained.

Although there has been described herein a method of manufacturing barrel-shaped springs, this invention is not limited to the manufacture of such springs. For example, the method of the invention can be applied to the manufacture of cylindrical springs, conical springs, combinations of these springs, and a coil spring having different partial pitch portions. Materials for these coil springs may be elongated element wire, or cut element wires with a predetermined length, or element wires with other sectional configurations than a circular shape. According to the method of this invention, a coil spring can be formed through a hot working, warm working or cold working.

Figure 7:
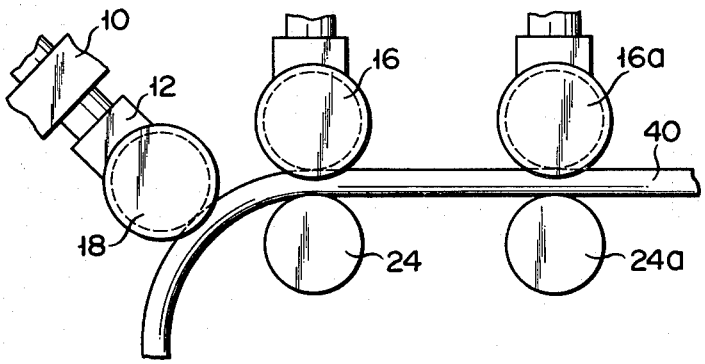
FIGS. 7 and 8 show alternative examples of the arrangements of support and pressing rollers.

There may be proposed various modifications of the method of coil spring manufacture as follows. In the above-mentioned embodiment, the support roller 24 is fixed, whereas the pressing rollers 16 and 18 are movable. As shown in FIG. 7, however, only the pressing roller 18 on the down-course side of the element wire 40 may be moved along with the first support member 12 to curve the element wire 40 so that the other pressing roller 16, together with the support roller 24, may hold the element wire 40 to guide the same in a predetermined direction. Moreover, two guide rollers 24*a* and 16*a* may be additionally provided to further stabilize the feed path of the element wire 40.

Figure 8:
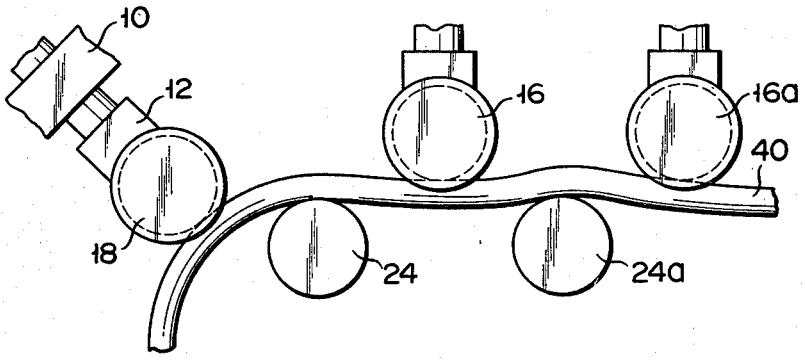

As shown in FIG. 8, moreover, the guide roller 24a and 16a, support roller 24, and pressing roller 16 may be arranged alternately.

Figure 9:
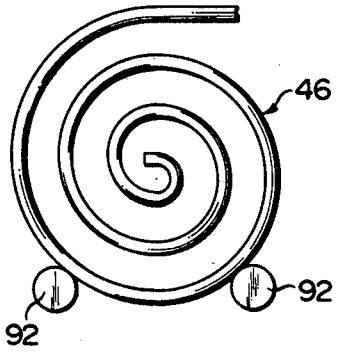
FIG. 9 shows another example of the method of supporting the coil spring being formed on the coiling machine of FIG. 1.

Instead of using the movable shaft 36 inserted in the front end turn portion 46a, there may be used a plurality of movable projections 92 which support the coil spring being coiled at its maximum-diameter portions, as shown in FIG. 9, or a combination of the movable shaft 36 and the projections 92. The movable shaft 36 and the end support shaft 37 attached thereto may be omitted if the coil spring being formed has a relatively short free length or so far as the standards for other dimensions and properties permit. Further, all or some of the shafts 14, 26 and 36 may be arranged in a direction which is not parallel with the shaft 22 of the support roller 24. Furthermore, the pitch of the coil spring may be determined by rocking the pitch tool 32 instead of moving it in parallel with the shaft 26. In the above embodiment, the pitch tool 32 and the end support shaft 37 are rotatably mounted on their corresponding shafts 30 and 36.

What we claim is:

1. A method of hot-forming a coil spring, comprising:

feeding an element wire along its longitudinal direction for forming a coil spring;

feeding said element wire through a first gap defined between a support roller disposed on one side of a path of the element wire and having a rotating shaft substantially perpendicular to said path and a first pressing roller disposed on the other side of said path and having a rotating shaft substantially parallel with said support roller;

feeding said element wire passed through said first gap through a second gap for winding said element wire to form a coil turn at the forward end of said element wire, said second gap being defined between said support roller and a second pressing roller disposed on the same side of said element wire as said first pressing roller and having a rotating shaft substantially parallel with said first pressing roller;

contacting said element wire delivered from said second gap against a rotatable pitch tool for adjustably shifting said element wire delivered from said second gap in parallel with said rotating shafts of said three rollers, thereby providing a coil with a desired pitch or pitches, said shifting being performed by said pitch tool which is rotatable when said element wire is being delivered from said second gap; and supporting the coil by inserting a freely rotatable support shaft within said coil turn and thereafter axially moving said support shaft while maintaining said support shaft in its supporting position within said coil turn at said forward end as further turns of the coil are subsequently wound by the continuous passage of said element wire through said first and second gaps so that coil turn does not slide on the surface of said support shaft and said coil does not sag due to the effect of gravity acting thereon, thereby preventing the coil from being undesirably scratched or deformed due to gravity;

the winding radius of each portion of said coil spring being determined by pressing said element wire against the surface of said support roller by means of said first and second pressing rollers and curving said element wire with a radius which is a function of the relative positions of said three rollers.

2. A method according to claim 1, further comprising adjusting the positions of said pressing rollers relative to said support roller to form a coil spring whose winding radius of each portion of said coil spring is function of said adjusting process.

3. A method according to claim 2, wherein said step of adjusting the relative positions of said pressing rollers and support roller comprises fixing said support roller at a predetermined position and displacing each of said pressing rollers in at least one predetermined direction and in a direction perpendicular to said predetermined direction.

4. A method according to claim 2, wherein said step of adjusting the relative positions of said pressing rollers and support roller comprises displacing said support roller.

5. A method according to claim 4, wherein said step of adjusting the relative positions of said pressing rollers and support roller further comprises displacing each of said pressing rollers respectively in at least one predetermined direction and in a direction perpendicular to said predetermined direction.

6. A method according to claim 4, further comprising computer-controlling the relative positions of said pressing rollers and said support roller automatically to form the winding radius of each portion of said coil spring.

7. A method according to claim 4, comprising fixing said pressing rollers at predetermined positions and only displacing said support roller.

8. A method according to claim 1, wherein said step of adjustably shifting said element wire comprises adjusting the position of the engaged coil portion of the formed coil relative to the other coils of the formed coil spring.

9. A method according to claim 1, wherein said support roller, said first pressing roller, said second pressing roller and said rotatable pitch tool all run at a peripheral speed substantially equal to the feeding speed of said element wire.

* * * * *

UNITED STATES PATENT AND TRADEMARK OFFICE

CERTIFICATE OF CORRECTION

PATENT NO. : 4,444,036

DATED : April 24, 1984

INVENTOR(S) : Masaharu SHIBATA, et al

It is certified that error appears in the above-identified patent and that said Letters Patent is hereby corrected as shown below:

COLUMN 8 (claim 2), line 17, after "coil spring", change "is function" to --is a function--

Signed and Sealed this

*Eighth* Day of *January 1985*

[SEAL]

*Attest:*

*Attesting Officer*

GERALD J. MOSSINGHOFF

*Commissioner of Patents and Trademarks*